US010760336B2

(12) United States Patent
Hwang

(10) Patent No.: US 10,760,336 B2
(45) Date of Patent: Sep. 1, 2020

(54) FALL ARRESTER

(71) Applicant: 3M Innovative Properties Company, St. Paul, MN (US)

(72) Inventor: Han Young Hwang, New South Wales (AU)

(73) Assignee: 3M Innovative Properties Company, St. Paul, MN (US)

( * ) Notice: Subject to any disclaimer, the term of this patent is extended or adjusted under 35 U.S.C. 154(b) by 582 days.

(21) Appl. No.: 14/900,783

(22) PCT Filed: Jun. 19, 2014

(86) PCT No.: PCT/AU2014/000635
§ 371 (c)(1),
(2) Date: Dec. 22, 2015

(87) PCT Pub. No.: WO2014/205479
PCT Pub. Date: Dec. 31, 2014

(65) Prior Publication Data

US 2016/0130875 A1 May 12, 2016

(30) Foreign Application Priority Data

Jun. 28, 2013 (AU) ..... 2013902395
Oct. 29, 2013 (AU) ..... 2013904178

(51) Int. Cl.
*E06C 7/18* (2006.01)
*A62B 1/14* (2006.01)
*A62B 35/00* (2006.01)

(52) U.S. Cl.
CPC ..... *E06C 7/186* (2013.01); *A62B 1/14* (2013.01); *A62B 35/0081* (2013.01)

(58) Field of Classification Search
CPC ..... A62B 35/0081; A62B 1/14
See application file for complete search history.

(56) References Cited

U.S. PATENT DOCUMENTS 4,560,029 A * 12/1985 Dalmaso ..... A62B 35/04 182/112
5,316,103 A 5/1994 Bell et al.
(Continued)

FOREIGN PATENT DOCUMENTS

WO 201256556 11/2012
WO 2012164279 12/2012

OTHER PUBLICATIONS

Supplementary European Search Report issued in International Application No. PCT/AU2014000635 dated Apr. 5, 2017 (3 pages).
(Continued)

*Primary Examiner* — Katherine W Mitchell
*Assistant Examiner* — Candace L Bradford

(57) ABSTRACT

The present invention relates broadly to a fall arrester (10) attached to a user's harness via a coupling arrangement (6). The fall arrester (10) is designed to be attached to a backup rope or safety line (12). The fall arrester 10 ( )comprises a body (14), and a lever (16) pivotally coupled to the body (14). The lever (16) includes a primary cam (18) which is arranged to co-operate with the coupling arrangement (6). In operation, descent of the user urges the coupling arrangement (6) into contact with the lever 16 which pivots to effect braking of the safety line (12) between the body (14) and the primary cam (18). Some preferred embodiments include an inertial cam to initiate pivotal movement of the lever for braking of the rope with the primary cam; a tow cam connected to a tow line which includes a mechanical fuse; a secondary cam connected to the lever whereby panic gripping the rope and the coupling toward one another promotes braking of the rope between the primary cam and the body; an accelerator element to accelerate contact of the coupling with the lever; and an inverted cam to ensure correct orientation of the fall arrester.

24 Claims, 13 Drawing Sheets

(56) References Cited

U.S. PATENT DOCUMENTS

| | | | | |
|---|---|---|---|---|
| 5,860,493 | A | 1/1999 | Cherpitel | |
| 5,934,408 | A * | 8/1999 | Flux | A62B 35/04 182/192 |
| 6,009,977 | A | 1/2000 | Pelofi | |
| 6,056,086 | A | 5/2000 | Gortan et al. | |
| 6,155,384 | A | 12/2000 | Paglioli | |
| 2011/0186388 | A1 | 8/2011 | Sudale et al. | |
| 2012/0241700 | A1 | 9/2012 | Mauthner et al. | |
| 2014/0020983 | A1 * | 1/2014 | Casebolt | A62B 35/0037 182/241 |
| 2019/0099625 | A1 * | 4/2019 | Muessig | A62B 1/14 |

OTHER PUBLICATIONS

International Search Report issued in International Application No. PCT/AU2014/000635, filed Jun. 19, 2014, 7 pages.

Kong, Italy, Work Positioning: Back-Up #802 fall arrester, Product Information Sheets [retrieved on Dec. 29, 2015] Retrieved from the Internet URL: https://web.archive.org/web/20130310133553/http://www.kong.it/instructions/I_KONG_BACK_UP.pdf Published on Mar. 10, 2013 as per Wayback Machine.

Kong Back Up 7/16 Rope Grab [retrieved on Dec. 22, 2015] from the Internet, URL: https://web.archive.org/web/20130326063028/http://www.patrollersupply.com/equipment/item_2611.asp Published on 36 Mar. 2013 as per Wayback Machine.

Kong #802 Back-Up, published Mar. 17, 2011, [retrieved on Dec. 22, 2015], Retrieved from the Internet URL: http://www.usrigging.com/pdfs/Kong802Back-Up.pdf.

Camp Safety Goblin Fall—Arrest Device Technical Information Sheet, published Sep. 27, 2012, [retrieved on Dec. 22, 2015] Retrieved from the Internet URL: http://www.abaris.co.uk/back-up-devices/camp-goblin-fall-arrester.htm.

Irata News, Back-up tests Lithuania interim report, published May 22, 2012 [retrieved Dec. 22, 2015], Retrieved from the Internet URL: http://www.irata.org/pdf%20downloads/100kg%20Abseil%20Position%20Drop%20Test%20V3.pdf.

Safetec Duck R. published Jun. 27, 2013 [retrieved Dec. 22, 2015], retrieved from the Internet URL: http://www.access-techniques.com/stec-duck-r-the-new-shunt.

ISC: International Safety Components Ltd RED Rope Brab Backup device w/Popper tow cord [retrieved Dec. 22, 2015] retrieved from the Internet, URL https://web.archive.org/web/20130218232812/http://www.patrollersupply.com/equipment/item_4140.asp published on Feb. 18, 2013 as per Wayback Machine

* cited by examiner

FALL ARRESTER

FIELD OF THE INVENTION

The present invention relates broadly to a fall arrester.

BACKGROUND TO THE INVENTION

FIG. 1 illustrates a common rope access system used for descent of a user 1 where a descender device 2 engages a working rope 3 for controlled descent, and a fall arrester 4 engages a backup rope 5. If the descender device 2 or other associated equipment fails, the fall arrester 4 automatically brakes on the backup rope 5 to arrest fall of the user 1. There are various fall arrester designs which can be generally categorised as either automatic hands-free followers or back-up manual devices.

In a typical automatic follower there is provided a housing having a hinged gate for enclosing the backup rope. The follower also includes a large cam and lever with a head of the lever coupled to a user's harness via a lanyard and carabiner-style snap hook. If the user falls the lever pivots the large cam which brakes the backup rope within the housing.

In a typical manual device there is provided a primary cam for braking where the user's carabiner and lanyard is connected to a body of the device. The body includes a pivoting cover plate which can be opened for locating the fall arrester on the backup rope. The manual device, on rapid descent of a user, rocks the housing relative to the primary cam for braking of the rope. The manual device also includes a secondary cam and lever which connects to the user's carabiner so that rocking of the housing is promoted by the secondary cam which frictionally engages the backup rope. This style of manual device presents a dropped objects hazard in that it must be detached from the user's carabiner when attaching to the backup rope.

It is to be understood that any acknowledgement of prior art in this specification is not to be taken as an admission that this prior art forms part of the common general knowledge.

SUMMARY OF THE INVENTION

According to a first aspect of the present invention there is provided a fall arrester comprising:

- a body adapted to couple to a user via a coupling;
- a lever including a primary cam, the lever pivotally coupled to the body and arranged to cooperate with the coupling whereby in operation descent of the user urges the coupling into contact with the lever which pivots to effect braking of rope passing through the fall arrester between the primary cam and the body.

Preferably the fall arrester also comprises an inertial cam pivotally coupled to the lever proximate the primary cam and configured on rapid descent of the user to pivot into contact with the rope to initiate pivotal movement of the lever for braking of the rope with the primary cam.

According to a second aspect of the invention there is provided a fall arrester comprising:

- a body adapted to receive a rope;
- a lever including a primary cam arranged to brake the rope on descent of the fall arrester, the lever pivotally coupled to the body;
- a tow cam movably coupled to the body and configured to contact the lever to pivot it and release the primary cam from the rope to permit manual towing of the fall arrester along the rope during its descent.

Preferably the body includes a closed opening adapted to retain the coupling. More preferably the lever is positioned relative to the closed opening whereby ascent of the user provides contact of the coupling with the body to effect raising of the fall arrestor independent of the lever and the primary cam.

Preferably the fall arrester also comprises a secondary cam connected to the lever whereby gripping the rope and the coupling toward one another urges the rope into contact with the secondary cam pivoting the lever to promote braking of the rope between the primary cam and the body. More preferably the secondary cam is pivotally connected to the lever and biased to maintain contact with the rope to hold the fall arrester at a required position along the rope. Even more preferably the fall arrester further comprises a secondary cam lock connected to the lever and arranged to lock the secondary cam in a retracted position to permit sliding movement of the fall arrester in both directions along the rope.

Preferably the fall arrester additionally comprises a tow cam pivotally coupled to the body to provide contact with the lever to pivot it and release the associated primary cam from the rope to permit manual towing of the fall arrester along the rope on its descent. More preferably the tow cam is configured relative to the lever to disengage from the lever to permit braking of the rope via the primary cam beyond a predetermined pivot angle of the tow cam. Even more preferably the tow cam connects to a tow line which is manually pulled to pivot the tow cam to allow towing of the fall arrester. Still more preferably the tow line includes a mechanical fuse which breaks at a predetermined pull load wherein the tow cam is deactivated.

Preferably the fall arrester still also comprises an accelerator element pivotally coupled to the body and adapted to engage the coupling to accelerate contact of the coupling with the lever for accelerated braking of the rope with the primary cam. More preferably the accelerator element is operatively coupled to a biasing member which urges the coupling to maintain contact with the lever.

Preferably the body includes a base body and a movable cover plate which in an open position provides for attachment of the fall arrester to the rope. More preferably the body is configured with the cover plate in a closed position to substantially house at least the primary cam and the lever. Even more preferably the body includes an inverted cam movably mounted to the base body to only permit closure of the cover plate into the closed position with the fall arrester correctly oriented relative to the rope to ensure braking on descent.

Preferably the fall arrester is integrally connected to the coupling. More preferably the coupling is in the form of a swivel connector.

BRIEF DESCRIPTION OF THE FIGURES

In order to achieve a better understanding of the nature of the present invention preferred embodiments of a fall arrester will now be described, by way of example only, with reference to the accompanying drawings in which.

DETAILED DESCRIPTION OF THE PREFERRED EMBODIMENTS

Figure 1:
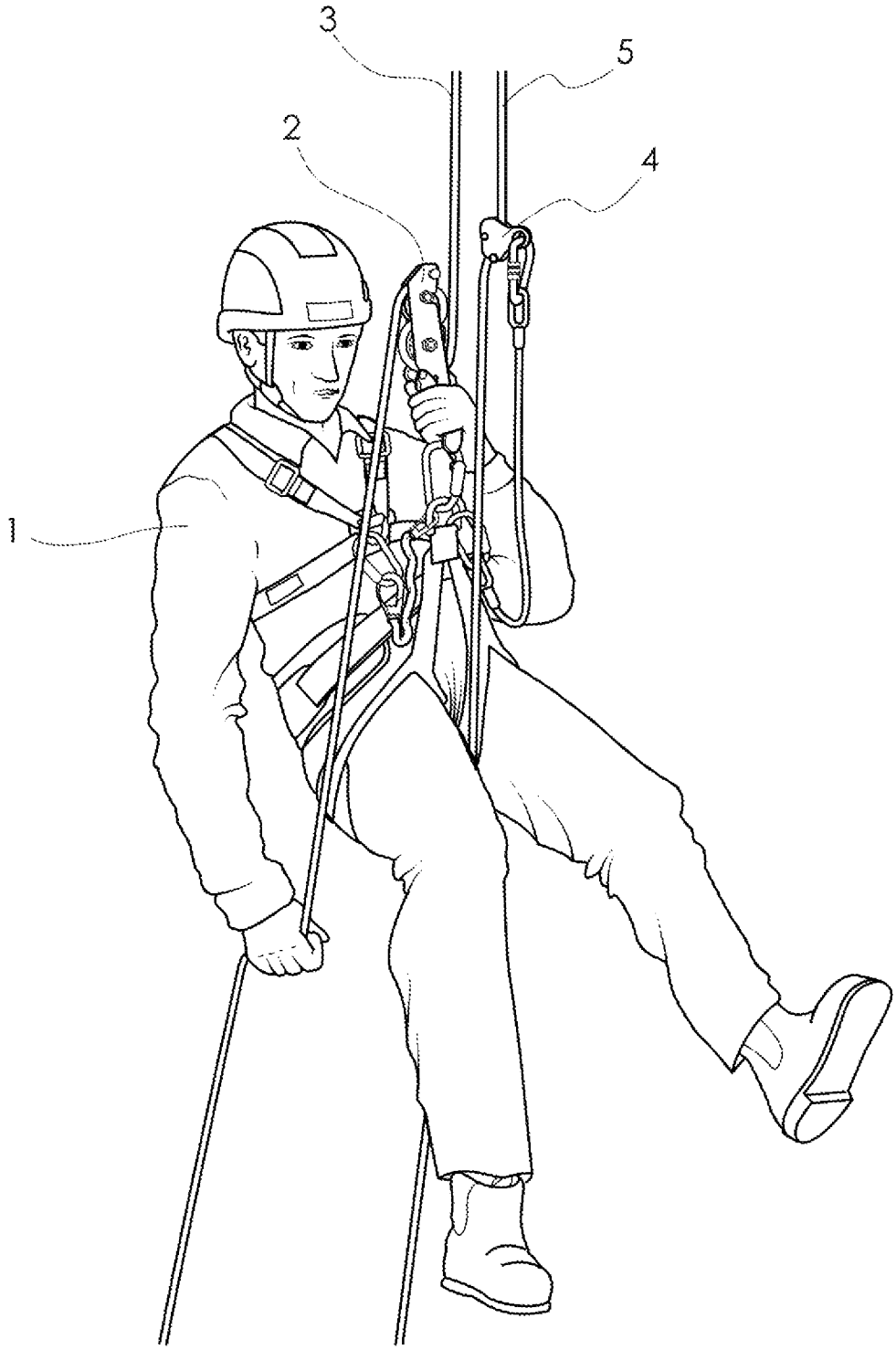
Prior Art Fig. 1
FIG. 1 is a schematic illustration of a common rope access system including a fall arrester.
Figure 2:
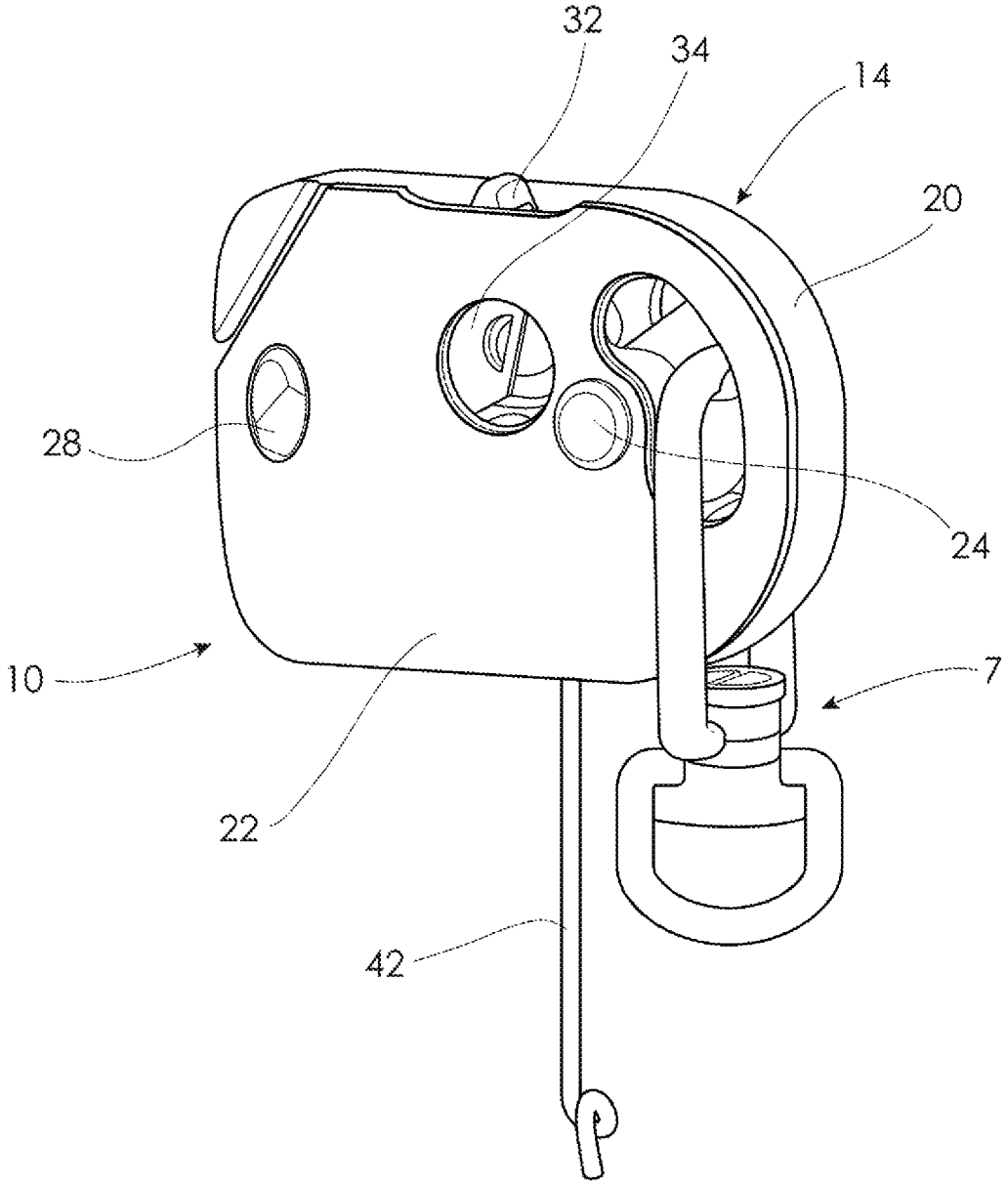
FIG. 2 is a perspective view of a fall arrester of an embodiment of the invention together with a coupling.
Figure 3A:
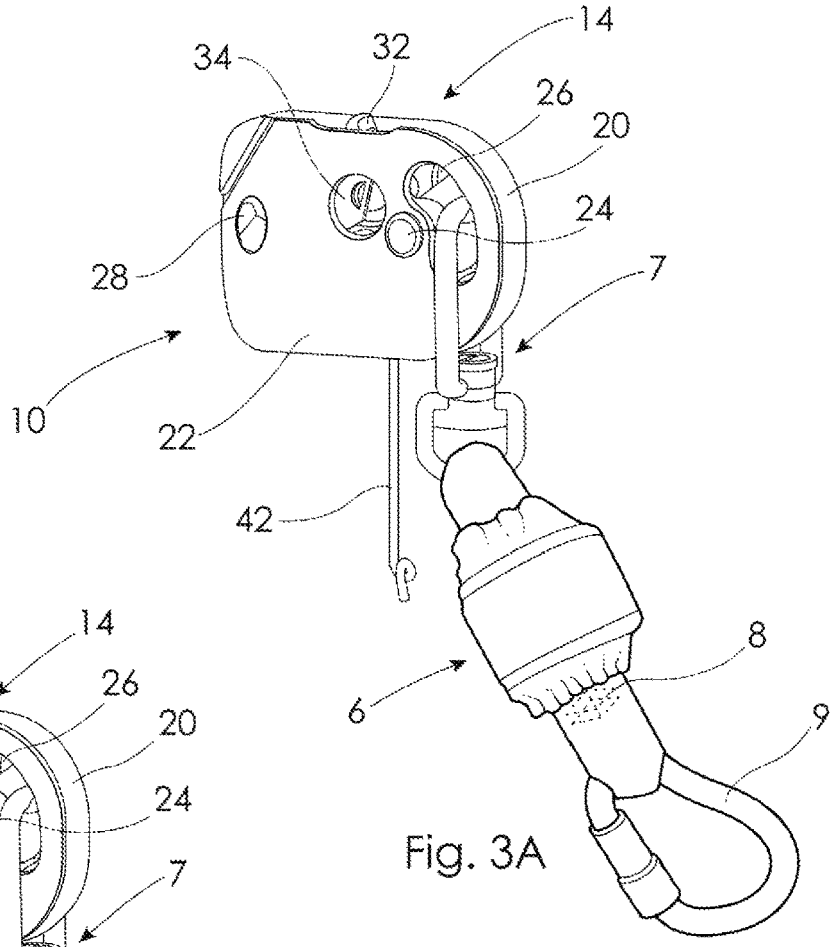
FIGS. 3A and 3B are perspective views of the fall arrester of FIG. 2 together with different length coupling arrangements.
Figure 3B:
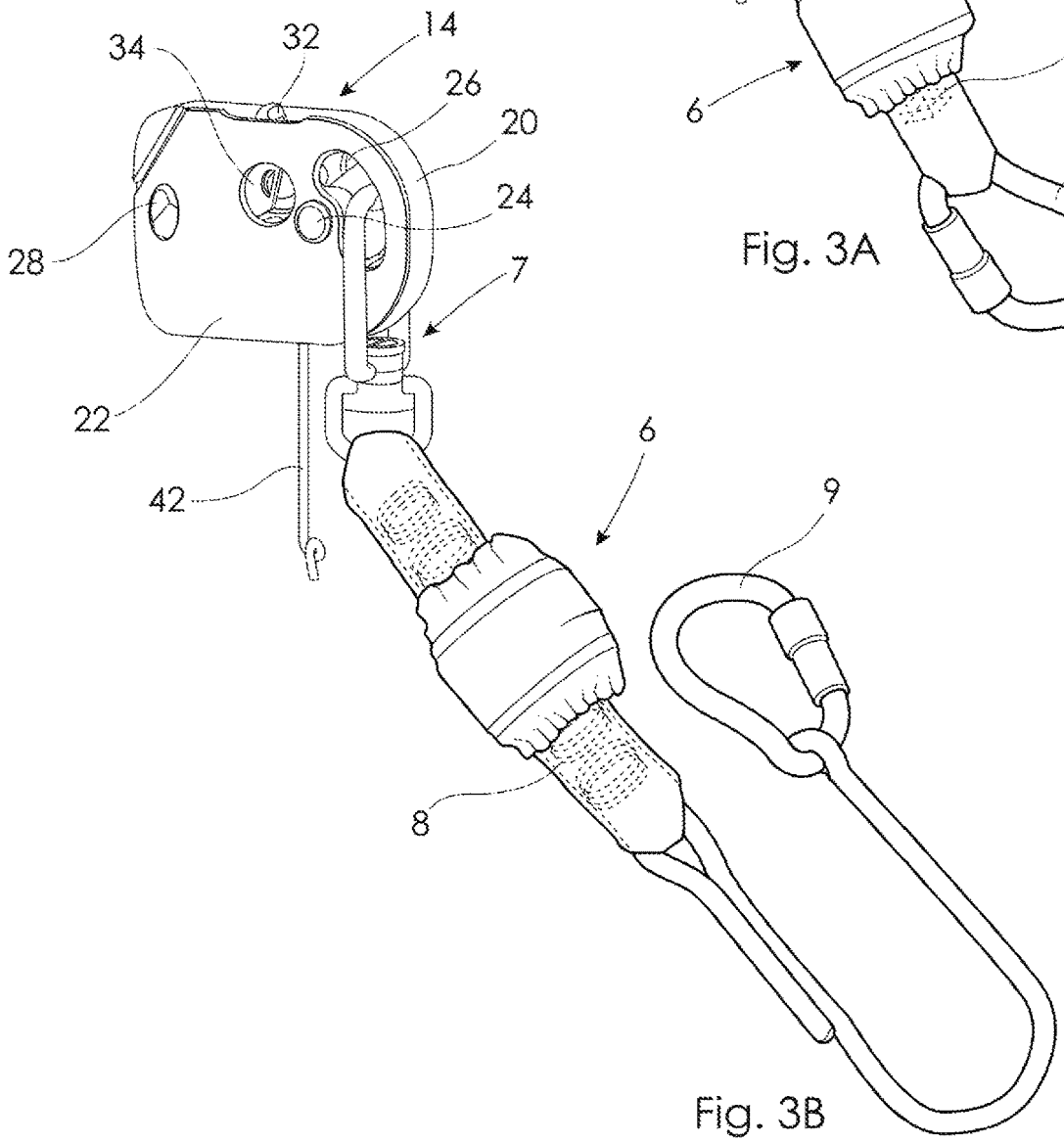

As best shown in FIGS. 2 and 3A/3B there is a fall arrester 10 according to a preferred embodiment of the present invention which is coupled to a user's harness (not shown) via a coupling arrangement 6. In this embodiment the coupling arrangement 6 includes a coupling in the form of a swivel connector 7 connected integral with the fall arrester 10. The swivel connector 7 is connected to either a short or long lanyard 8 as shown in FIGS. 3A and 3B, respectively. The lanyard 8 is at an opposite end connected to a carabiner 9 which detachably connects to a connection point defined by a D-ring (not shown) attached to the harness.

Figure 4A:
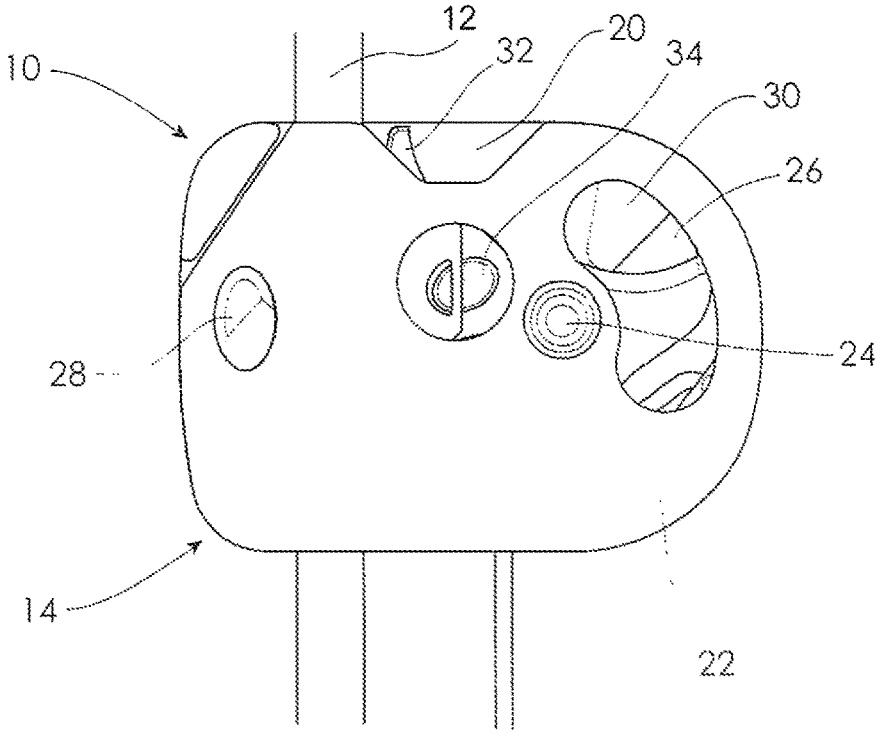
FIGS. 4A and 4B are side elevational views of the fall arrester of FIG. 2 in closed and open configurations respectively.

As best shown in FIGS. 4A/B and 5 the fall arrester 10 is designed to be attached to a backup rope or safety line 12. The fall arrester 10 comprises a body 14, and a lever 16 pivotally coupled to the body 14. The lever 16 includes a primary cam 18 which in this embodiment is formed integral with the lever 16 which is arranged to co-operate with a coupling, an example of such a coupling being the coupling arrangement 6. In operation, descent of the user urges the coupling into contact with the lever 16 which pivots to effect braking of the safety line 12 between the body 14 and the primary cam 18.

Figure 4B:
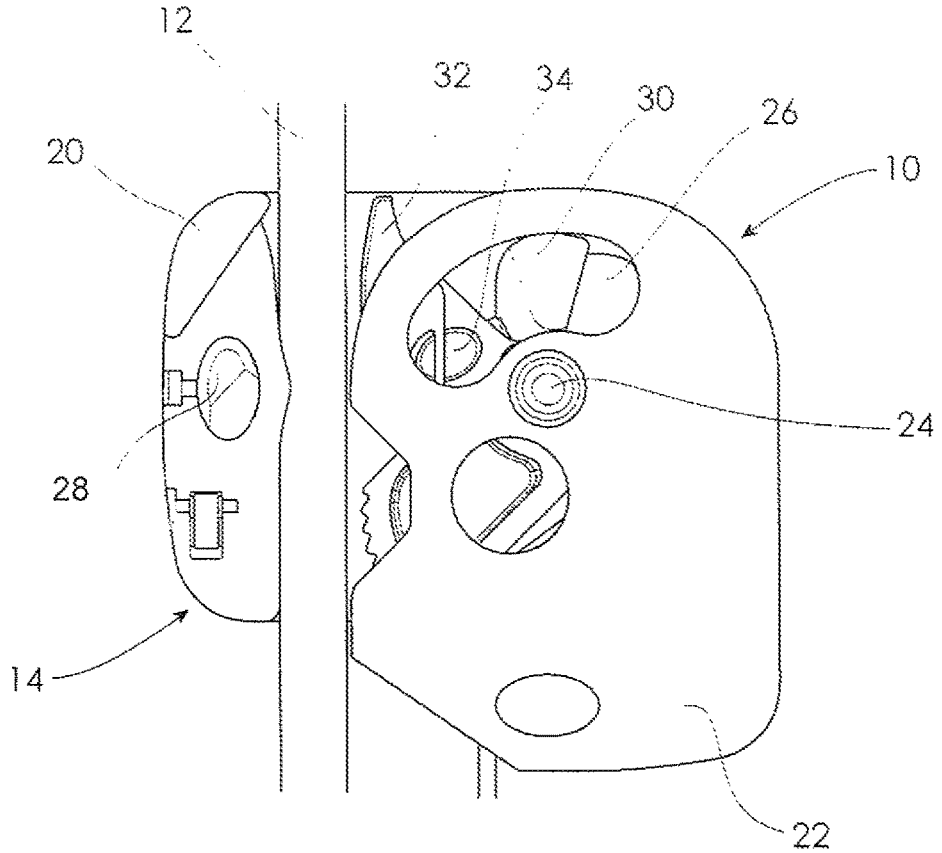

The body 14 includes a base body 20 and a moveable cover plate 22 which in this example pivots about the base body 20. The base 14 includes a pivot axle 24 about which the cover plate 22 pivots. The pivot axle 24 also provides a pivotal mount to which the lever 16 is pivotally coupled. The base body 20 together with the cover plate 22 define a closed opening 26 designed to retain the coupling. The base body 20 and the cover plate 22 are slotted so that the opening 26 is maintained for connection to the coupling with the cover plate 22 both closed and open as illustrated in FIGS. 4A and 4B respectively.

Figure 5:
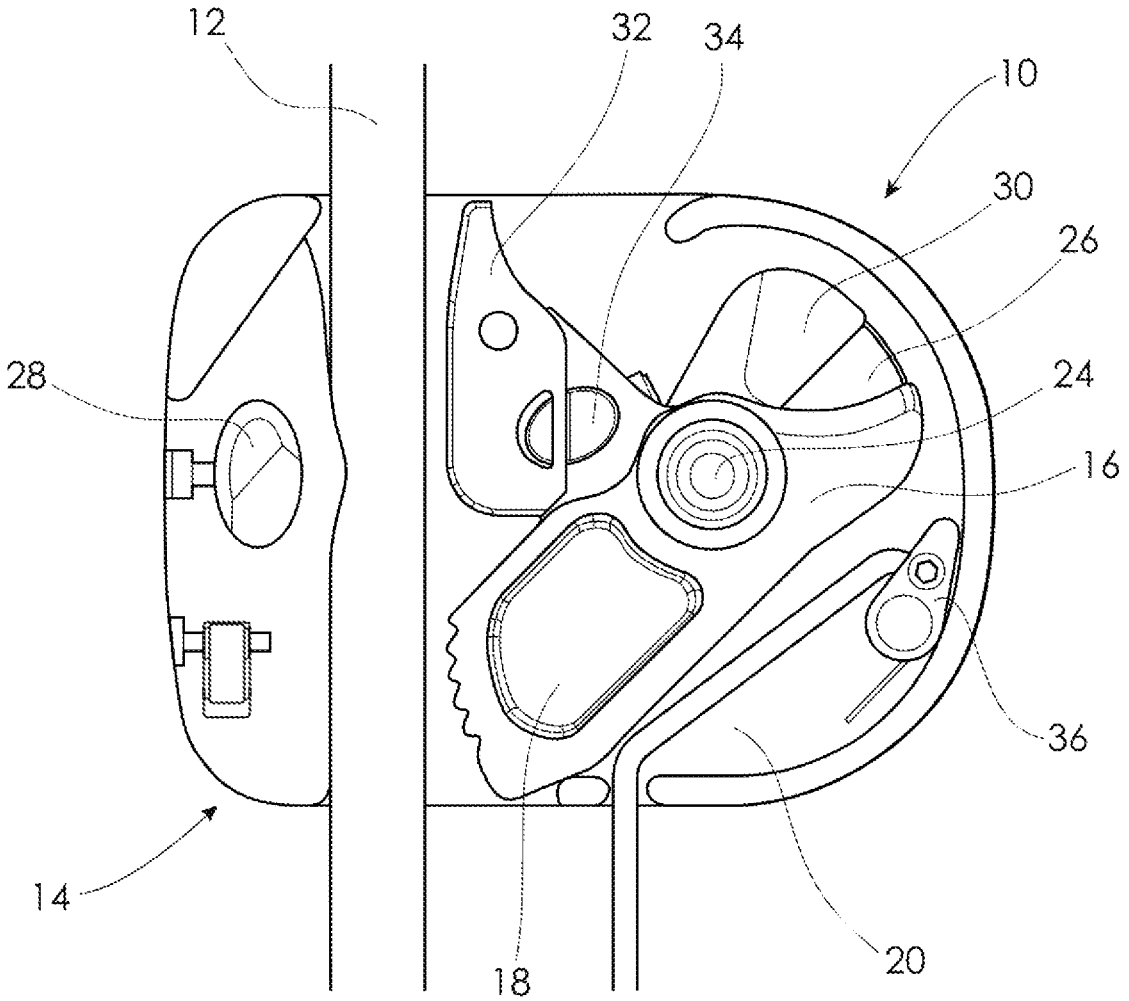
FIG. 5 is a side elevational view of the fall arrester of the embodiment of FIGS. 4A and 4B with the cover plate removed for clarity.

The base body 20 includes a retaining button 28 which retains the cover plate 22 in the closed position of FIG. 4A. The retaining button 28 is depressed to release the cover plate 22 and allow it to pivot about the pivot axle 24 into its open position as shown in FIG. 4B. In operation, ascent of the user releases the coupling from the lever 16 and the coupling contacts the body 14 about the opening 26 to effect raising of the fall arrester 10 independent of the lever 16 and the primary cam 18. As best illustrated in FIG. 5, the primary cam 18 under the influence of gravity pivots away from the safety line 12 for relatively free movement of the fall arrester 10 along the safety line 12. In this embodiment the lever 16 and primary cam 18 are otherwise not actively biased.

The fall arrester 10 further comprises an accelerator element 30 pivotally coupled to the base body 20. The accelerator element 30 is biased via a biasing member in the form of a torsion spring (not shown) in a clockwise direction as viewed in FIG. 5 to maintain contact with the coupling. This means that on rapid descent of a user the coupling is forced by the accelerator element 30 into contact with the lever 16 to initiate braking of the safety line 12 with the primary cam 18. The accelerator element 30 thus avoids a situation where the fall arrester 10 accelerates at the same rate as the user without the coupling contacting the lever 16 to effect braking via the primary cam 18.

Figure 6A:
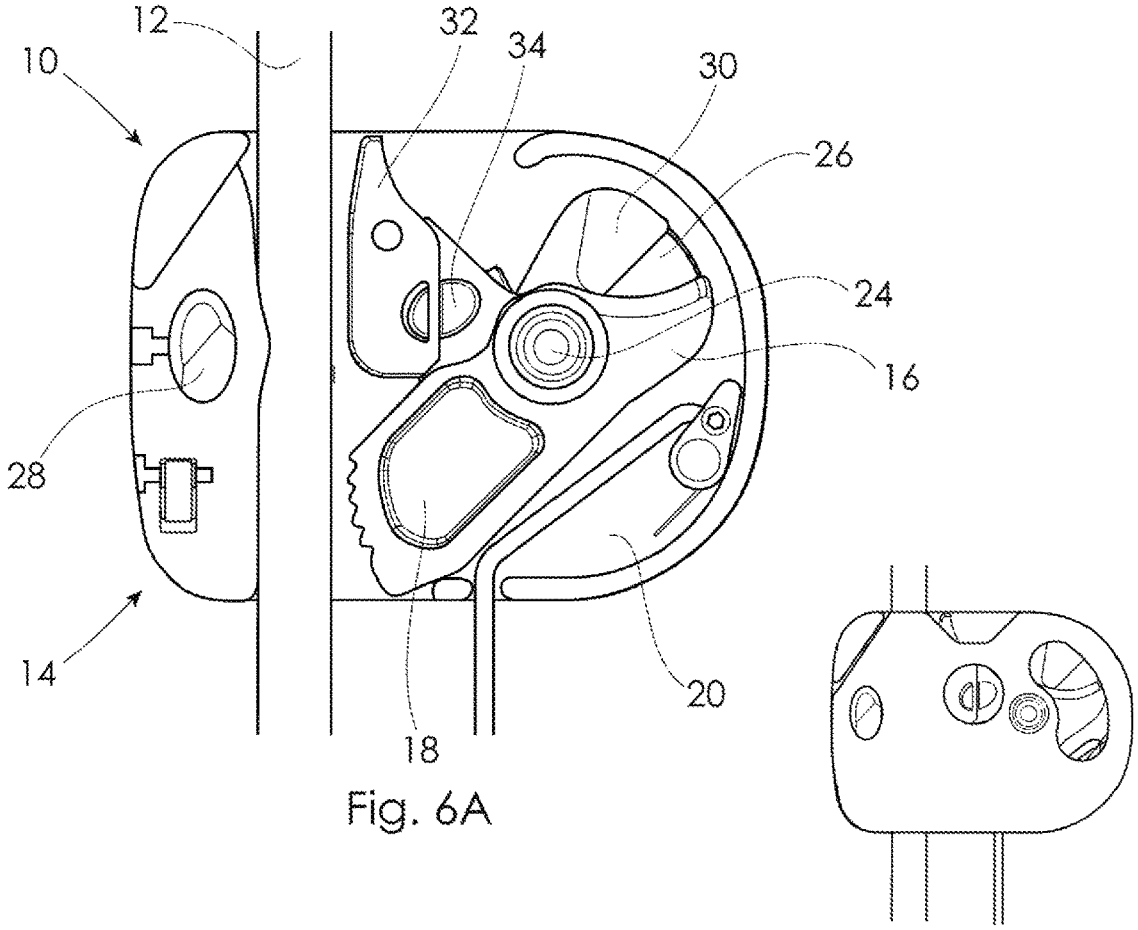
FIGS. 6A and 6B are side elevational views of the fall arrester of FIG. 5 shown in automatic and manual modes respectively.
Figure 6B:
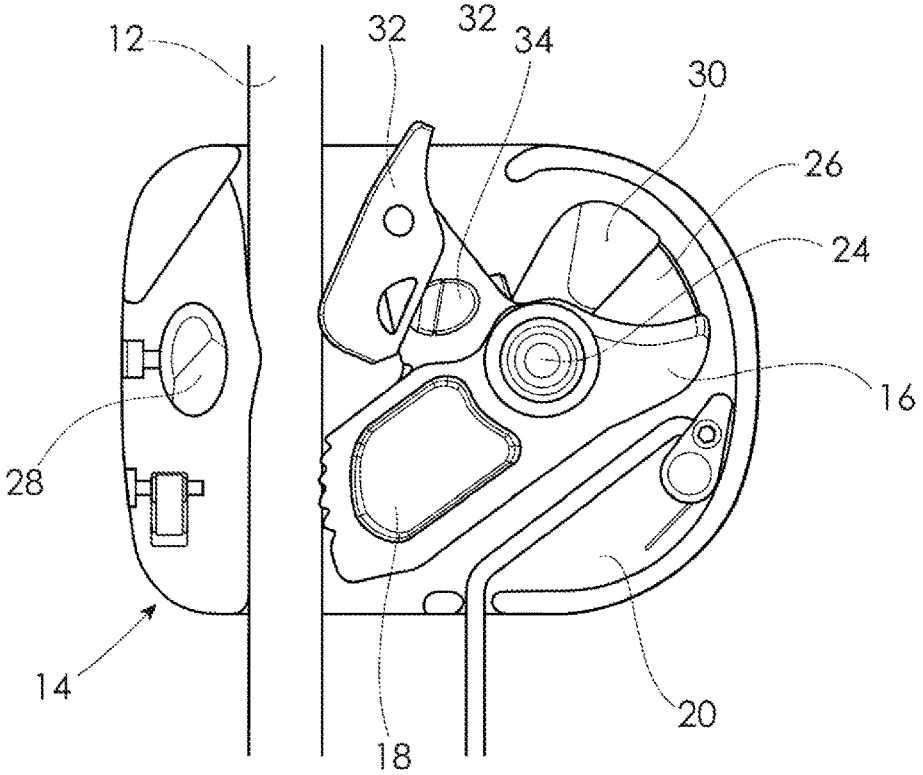

The fall arrester 10 also comprises a secondary cam 32 connected to the lever 16. The secondary cam 32 is designed so that gripping the safety line 12 and the coupling toward one another forces the safety line 12 into contact with the secondary cam 32. This contact with the secondary cam 32 pivots the lever 16 in a clockwise direction as shown in FIG. 6B to promote braking of the safety line 12 between the primary cam 18 and the body 16. The secondary cam 32 in this embodiment is pivotally connected to the lever 16 to permit operation of the fall arrester 10 in either an automatic or manual mode as shown in FIGS. 6A and 6B respectively.

The fall arrester 10 further comprises a secondary cam lock 34 mounted on the lever 16 and designed to retain the secondary cam 32 in a fixed and retracted position in the automatic mode. The secondary cam lock 34 is depressed to release the secondary cam 32 which is biased to pivot outwardly of the lever 16 into frictional engagement with the safety line 12 in the manual mode.

Figure 7A:
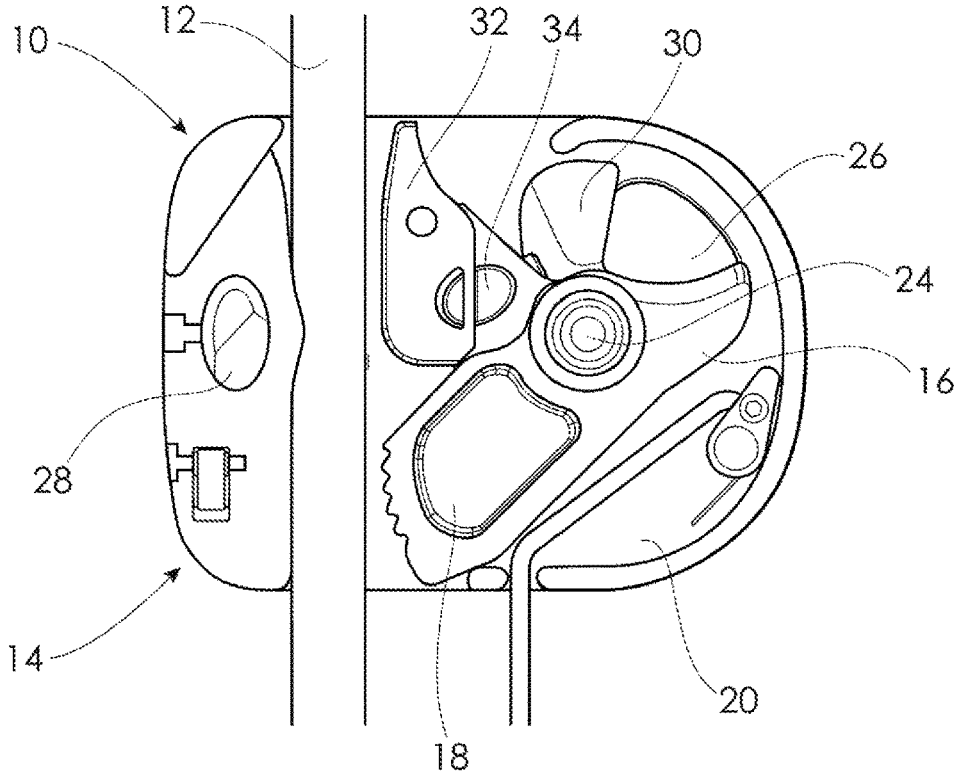
FIGS. 7A and 7B are side elevational views of the fall arrester of FIG. 5 in the automatic mode.
Figure 7B:
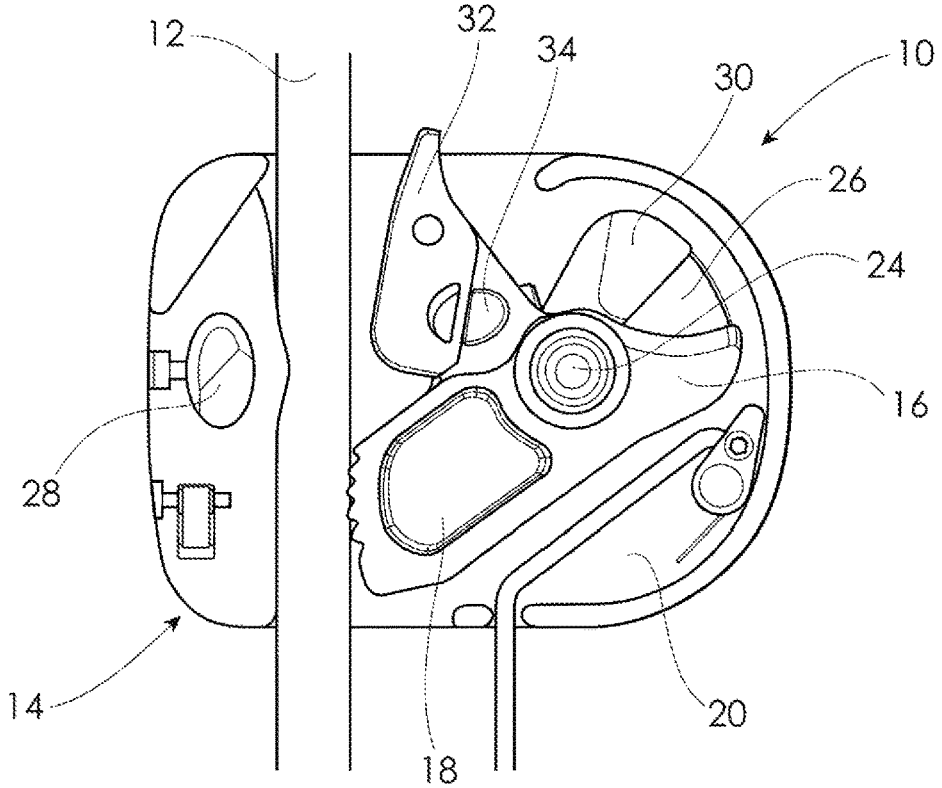

In the automatic mode as shown in FIG. 7A the fall arrester 10 is free to slide or float in both upward and downward directions along the safety line 12. In moving upwardly along the safety line 12 the coupling lifts the body 14 of the arrester 10 without influencing pivoting of the lever 16 which under the influence of gravity pivots in an anti-clockwise direction moving the primary cam 18 away from the safety line 12. The fall arrester 10 similarly travels downwardly along the safety line 12 without gripping the safety line 12. In travelling in both directions the secondary cam 32 is retracted clear of the safety line 12. In rapid descent the fall arrester 10 is activated wherein the accelerator element 30 pushes the coupling into contact with the lever 16 to rotate the primary cam 18 in a clockwise direction to effect accelerated braking of the safety line 12 with the primary cam 18.

Figure 8A:
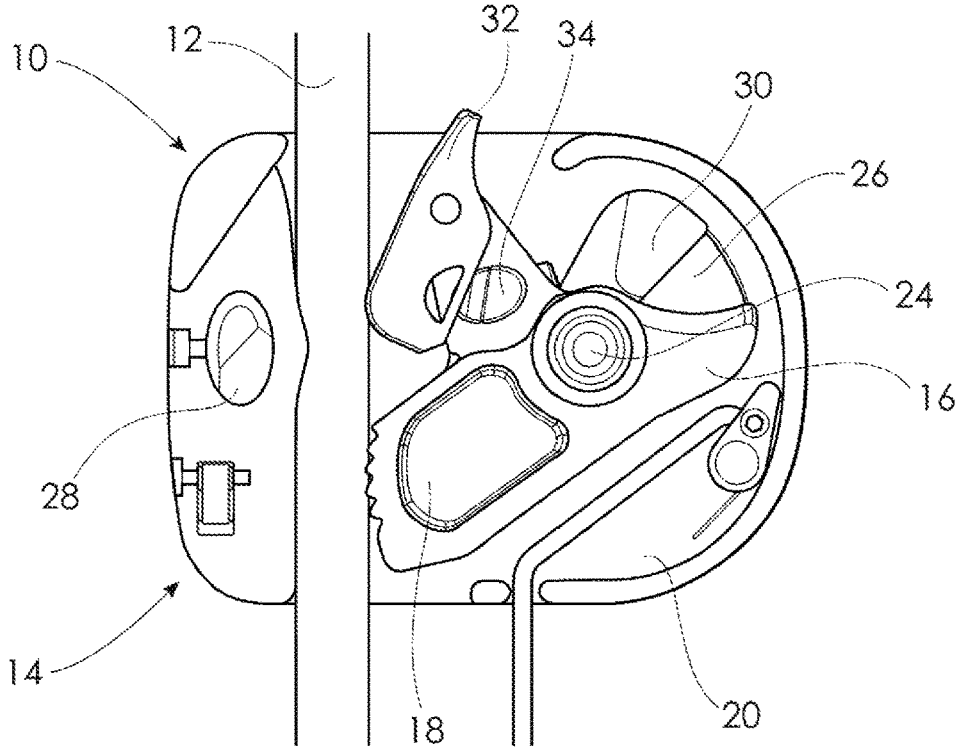
FIGS. 8A and 8B are side elevational views of the fall arrester of FIG. 5 in the manual mode.
Figure 8B:
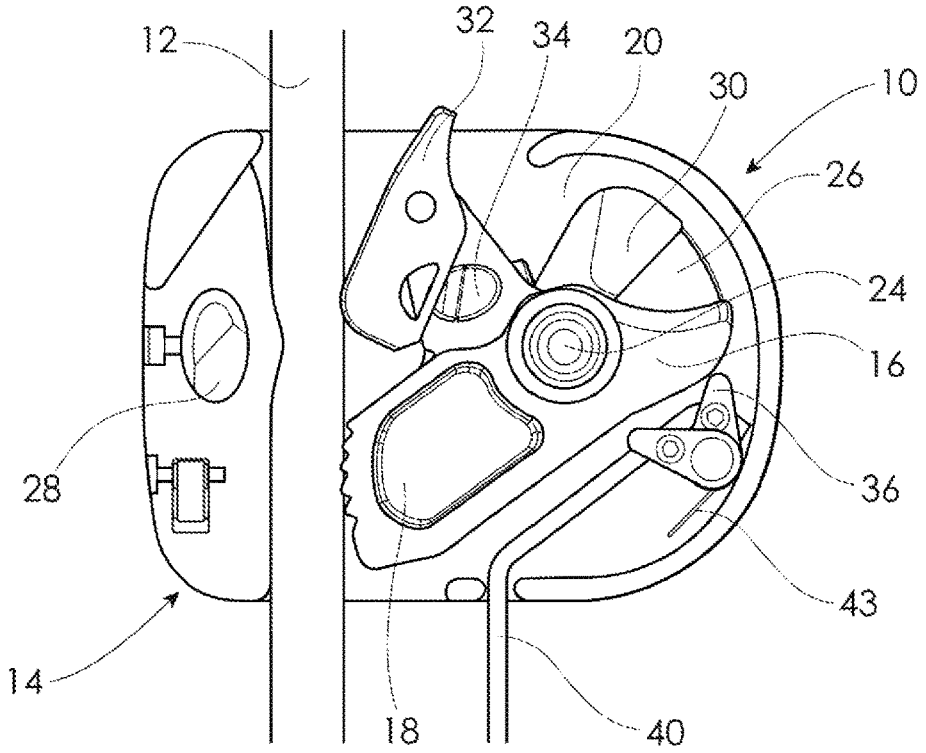

In the manual mode as illustrated in FIGS. 8A and 8B the secondary cam 32 is biased toward the safety line 12 by releasing or depressing the secondary cam lock 34. The secondary cam 32 thus maintains frictional engagement with the safety line 12 pivoting the lever 16 in a clockwise direction to press cam 18 against the safety line 12. This means that the fall arrester 10 is held stationary or parked at a required position along the safety line 12. The secondary cam 32 thus forces the primary cam 18 to lightly brake the safety line 12 to effectively park the fall arrester 10 at a required height. If the user rapidly descends or falls the coupling contacts the lever 16 pivoting the primary cam 18 to brake the safety line 12 against the body 14.

The fall arrester 10 as best illustrated in FIGS. 8A and 8B also comprises a tow cam 36 pivotally coupled to the base body 20. The tow cam 36 is designed in the manual mode to tow the fall arrester 10 downwardly along the safety line 12. The tow cam 36 is configured to contact an underside surface 38 of the lever 16 to pivot the lever 16 in an anti-clockwise direction to release the associated primary cam 18 from the safety line 12. A tow line 40 is connected to the tow cam 36 so that when the tow line 40 is pulled it pivots the tow cam 36 in the anti-clockwise direction. The tow cam 36 is actuated independent of the primary cam 18 via the tow line 40. The lever 16 at its underside surface 38 is shaped wherein the tow cam 36 beyond a predetermined pivot angle disengages from the lever 16. Up until the predetermined pivot angle, the tow cam 36 bears against the underlying surface 38 of the lever 16 to pivot the lever 16 and release the primary cam 18 from the safety line 12. The secondary cam 32 in the manual mode maintains frictional contact with the safety line 12 for smooth lowering of the fall arrester 10. The tow line 40 includes a mechanical fuse such as the breakaway cord 42 shown in FIG. 9. The breakaway cord 42 detaches from the remainder of the tow line 40 at a predetermined pull load wherein the tow cam 36 is deactivated. The tow cam 36 is biased in a clockwise direction via torsion spring 43.

Figure 9:
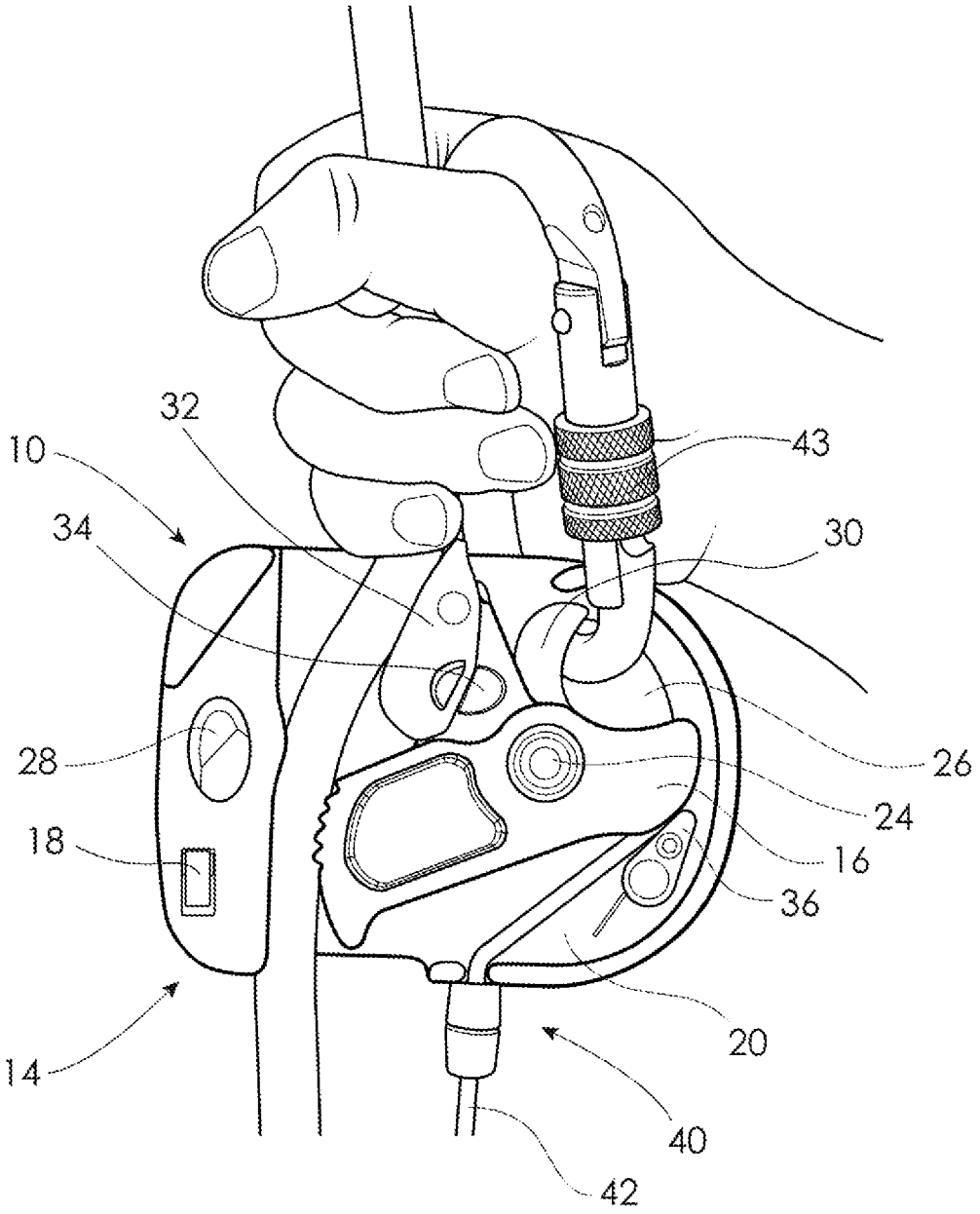
FIG. 9 is a schematic illustration of the fall arrester of FIG. 5 shown in the case of a "panic grip"

The body 14 of the fall arrester 10 of this embodiment houses the lever 16 and primary cam 18 together with the majority of the other moving components. The lever 16 is open-ended so that it is only effective in pivoting of the associated cam 18 on contact with the coupling in descent only. As illustrated in FIG. 9, this also means that in a "panic grip" the coupling or in this example the carabiner 43 does not contact the lever 16 and influence the primary cam 18. Rather, the secondary cam 32 in a "panic grip" contacts the safety line 12 and pivots the lever 16 and the associated cam 18 into braking contact with the safety line 12. The carabiner 43 moves freely within the slotted opening 26 with the accelerator element 30 being pivoted away against its biasing force.

Figure 10:
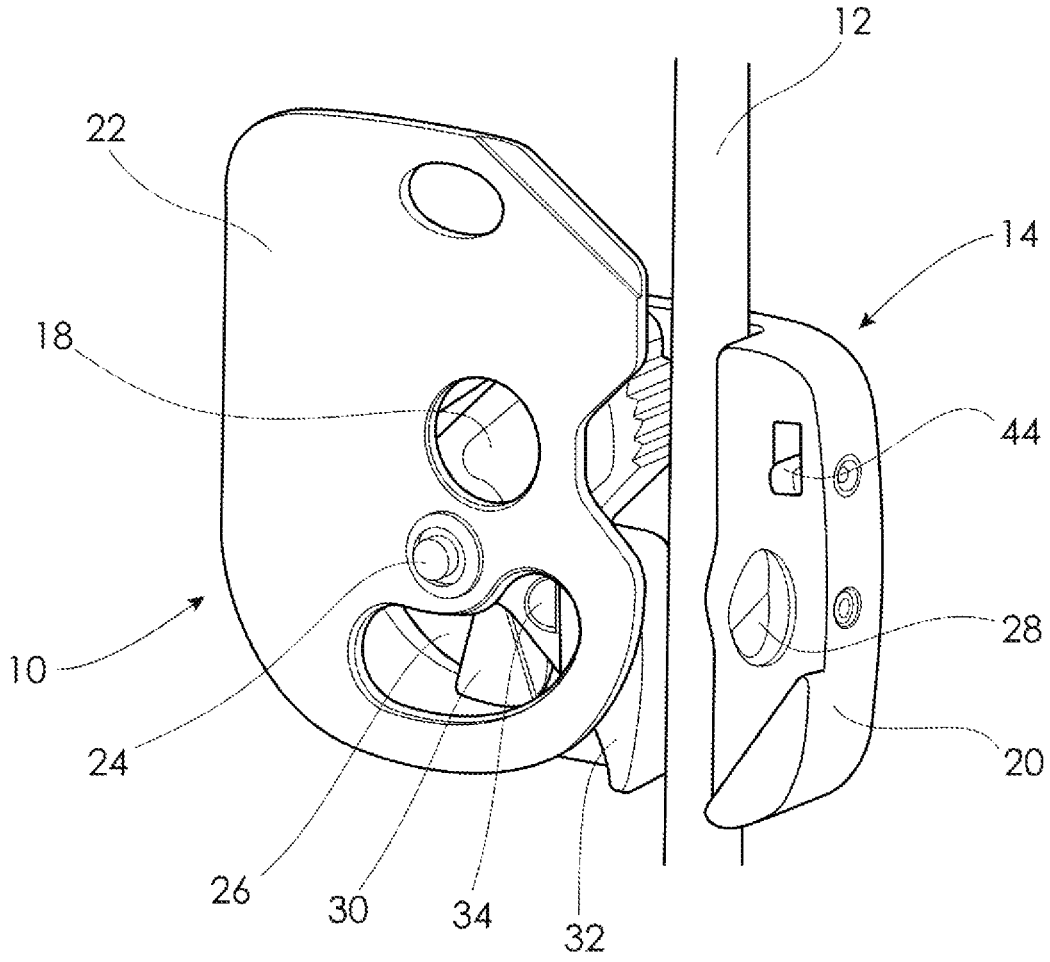
FIG. 10 is a perspective view of the fall arrester of FIG. 5 in an inverted position.

The fall arrester 10 as shown in FIG. 10 is configured so that it can be attached to the safety line 12 in a single orientation only wherein braking of the safety line 12 is effected on descent of the fall arrester 10. For this purpose the base body 20 is provided with an invert cam 44 which pivotally retracts with the fall arrester 10 oriented in the correct disposition. With the invert cam 44 retracted, the cover plate 22 is free to pivot across the base body 20 for retention with the button retainer 28. If the fall arrester 10 is incorrectly oriented relative to the safety line 12, the invert cam 44 extends from the base body 20 as shown in FIG. 10. This means the cover plate 22 is obstructed by the invert cam 44 not permitting full closure of the cover plate 22. This consequently alerts the user to incorrect orientation of the fall arrester 10.

In order to further understand the invention, operation of the preferred fall arrester 10 involves the following steps:

1. In a safe environment, the fall arrester 10 which is integrally connected to a coupling is connected to a user's harness via a lanyard and carabiner;

2. The fall arrester 10 is opened by depressing the retainer button 28 and pivoting the cover plate 22 anti-clockwise to present an elongate passage for attaching or capturing the safety line 12;

3. The cover plate 22 is pivoted in a clockwise direction for closure about the safety line 12;

4. The user descends a working rope using a conventional descender device and relies upon the fall arrester 10, typically in the automatic mode, to function as a backup safety device;

5. The user having descended to a required working height can elect to park the fall arrester 10 in a manual mode at a required height along the safety line 12;

6. The user can tow the fall arrester 10 in the manual mode sliding it downwardly along the safety line 12 using the tow line 40 and associated tow cam 36.

In the event of a fall or rapid descent, the fall arrester 10 in either its automatic or manual mode brakes or locks against the safety line 12 to arrest descent of the user.

If the tow line 40 is being used with the breakaway cord 42, the breakaway cord 42 will detach from the remainder of the tow line 40 and the tow cam 36 will be deactivated.

Figure 12A:
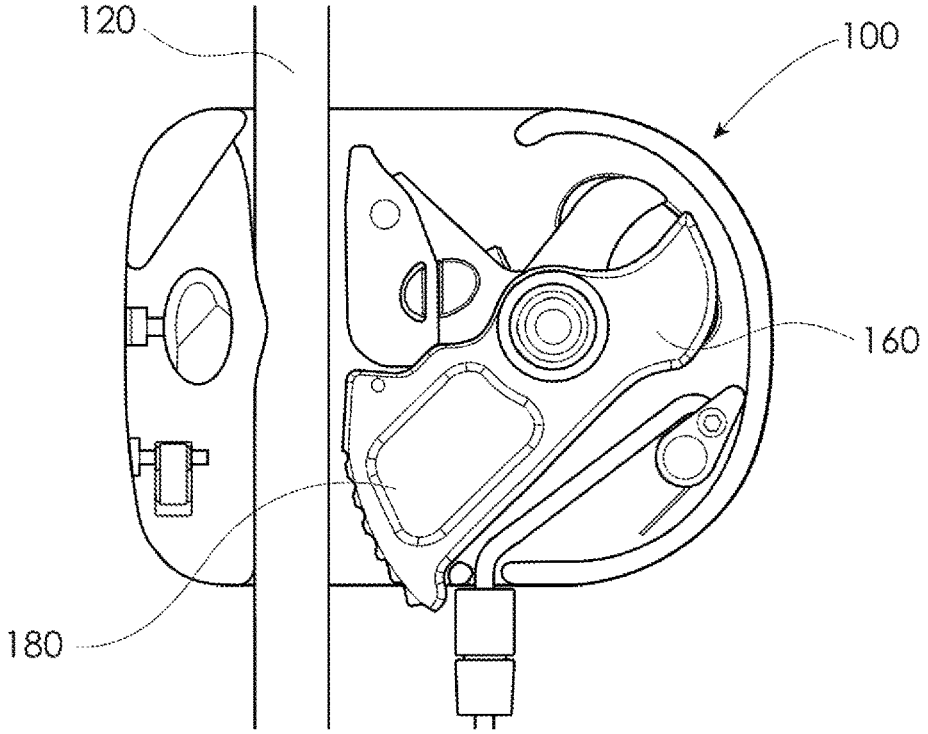
FIGS. 12A and 12B are side elevational views of the fall arrester of FIGS. 11A and 11B.
Figure 12B:
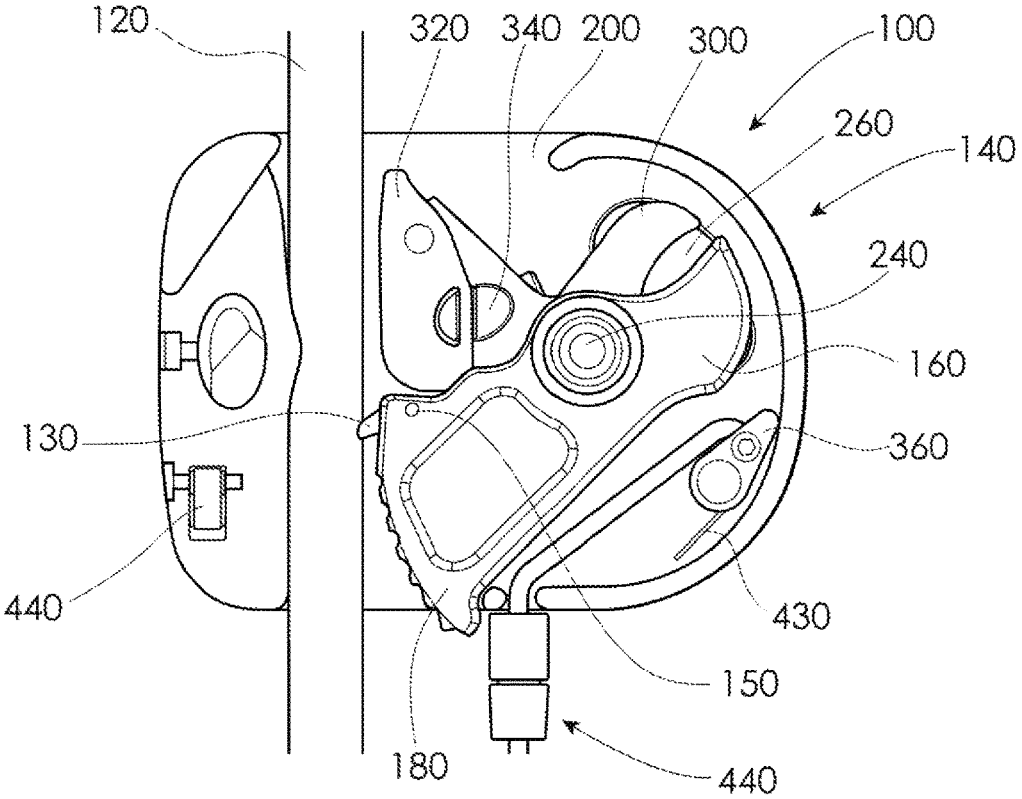
Figure 13:
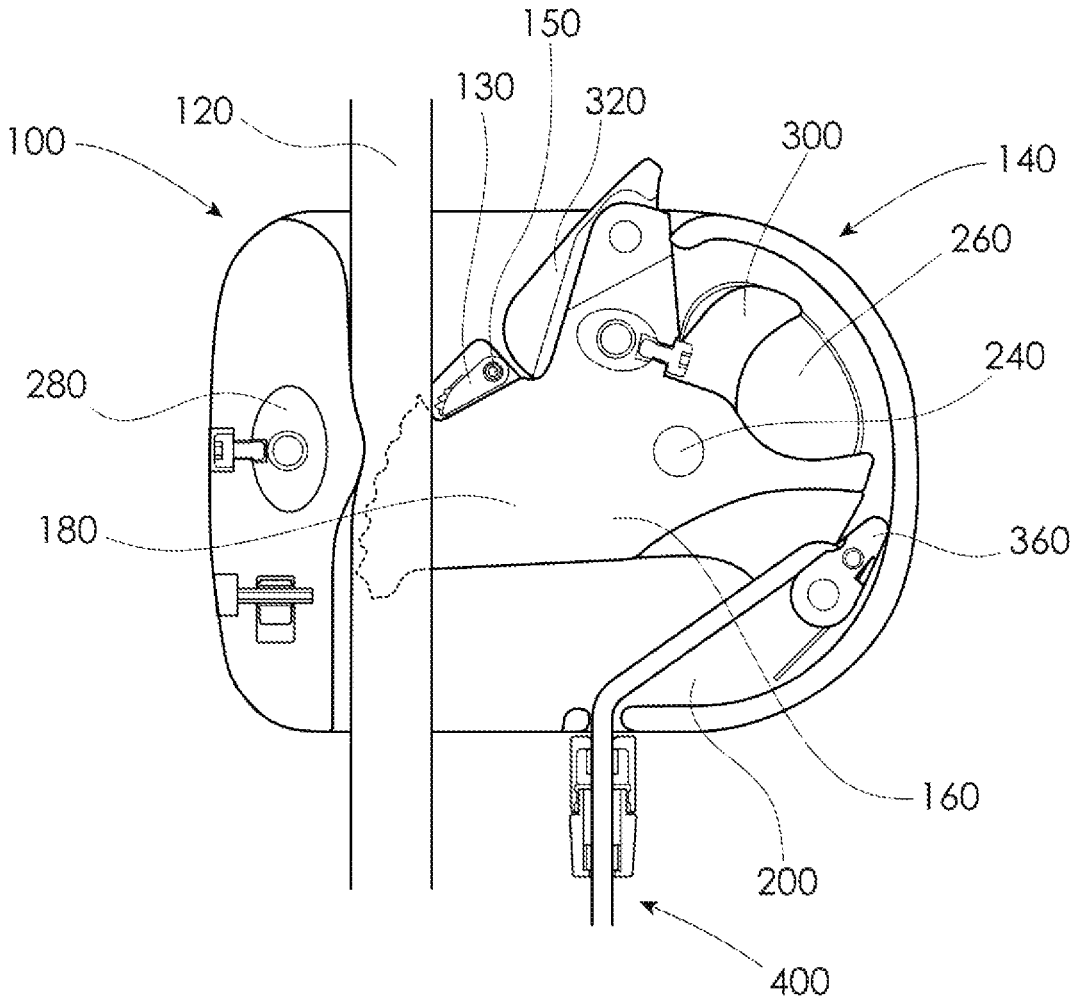
FIG. 13 is a cross-sectioned view of the fall arrester of FIGS. 11A and 11B shown in the automatic mode braking the rope.

FIGS. 11 to 13 show another embodiment of a fall arrester according to the present invention. The fall arrester 100 of this embodiment is essentially the same as the preceding embodiment except for the inclusion of an inertial cam 130. For ease of reference and in order to avoid repetition the fall arrester 100 is for corresponding components to the preceding embodiment shown or designated with an additional "0". For example, the housing of this fall arrester 100 is designated as 140.

Figure 11A:
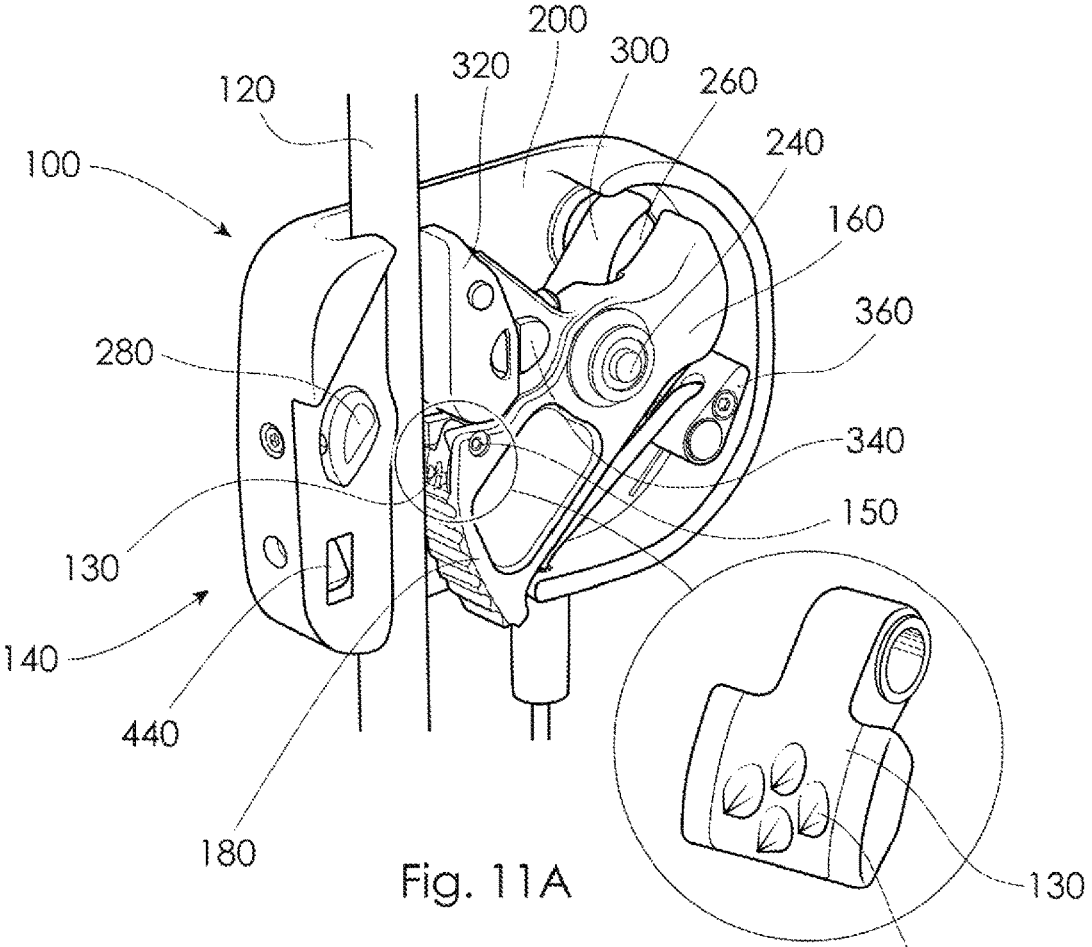
FIGS. 11A and 11B are perspective views of a fall arrester of another embodiment of the invention shown with the cover plate removed for clarity.
Figure 11B:
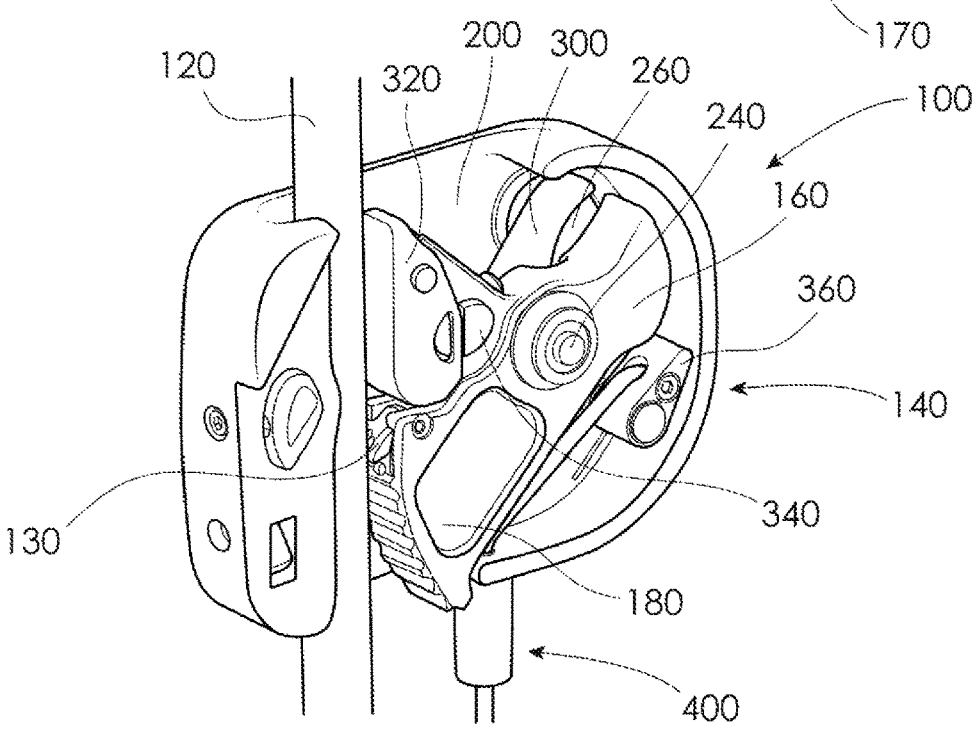

As best shown in FIG. 11A the inertial cam 130 is pivotally connected to the lever 160 at the primary cam 180. The inertial cam 130 pivots or swings about pivot pin 150 fixed to the lever 160 at the primary cam 180. The inertial cam 130 is configured on rapid descent of a user to pivot into contact with the rope 120 as shown in FIG. 11B. The inertial cam 130 contacts the rope 120 and thus initiates pivotal movement of the lever 160 and the associated primary cam 180 for braking of the rope 120 with the primary cam 180. The inertial cam 130 can thus swing from a retracted position of FIG. 11A for normal operation of the fall arrester 100 to an extended position of FIG. 11B for activation of the primary cam 180.

As shown in FIGS. 12A and 12B the fall arrester 100 can operate in an automatic mode with the secondary cam 320 in a fixed and retracted position. In the automatic mode the fall arrester 100 is free to slide or float in both upward and downward directions along the rope or safety line 120. In the event of rapid descent which may be associated with a panic grip, the inertial cam 130 as shown in FIG. 12B is swung outward of the primary cam 180 due to the inertia difference in the system. The inertial cam 130 includes teeth such as 170 designed to contact and pick up the rope 120 and thus initiate locking of the primary cam 180. In rapid descent the falling mass further activates the primary cam 180 for braking of the rope 120 to arrest the fall.

FIG. 13 depicts the fall arrester 100 with the rope 120 braked following rapid descent. Inertial cam 130 has retracted into a rebate 190 in the lever 160 at the primary cam 180. The inertial cam 130 in this retracted position does not contact or damage the rope 120. The fall arrester 100 is otherwise constructed to operate in a similar manner to the preceding embodiment.

Now that several preferred embodiments of the present invention have been described it will be apparent to those skilled in the art that the fall arrester has at least the following advantages:

1. The fall arrester is retained on the coupling or carabiner and lanyard whilst being attached or detached from the safety line thus eliminating a drop hazard;

2. The fall arrester can be operated in either an automatic or manual mode and these modes can be switched whilst in operation with relative ease;

3. The fall arrester eliminates hazards associated with a "panic grip" by one or a combination of the following design features:

i. The body houses the lever and associated primary cam so that the lever cannot be grasped;

ii. The carabiner or other coupling is not retained by the lever but rather contacts or engages the lever on descent only;

iii. The secondary cam on contact with the safety line urges the primary cam into braking contact with the safety line;

iv. The primary cam may include an inertial cam which ensures braking of the rope;

4. The fall arrester can be safely towed via the tow cam which is activated independent of the primary braking cam;

5. The tow cam is designed to deactivate if over pulled by panic.

Those skilled in the art will appreciate that the invention described herein is susceptible to variation and modifications other than those specifically described. For example, the shape and configuration of the fall arrester and its associated components may vary from that described provided it functions in accordance with the essential characteristics of the invention. The fall arrester need not necessarily include the secondary cam in which case it would function in the automatic mode only. All such variations and modifications are to be considered within the scope of the present invention the nature of which is to be determined from the foregoing description.

The invention claimed is:

1. A fall arrester comprising:

a body adapted to couple to a user via a coupling, the body including a base body and a moveable cover plate which in an open position provides for attachment of the fall arrester to a rope, the base body and the cover plate together defining a closed opening adapted to retain the coupling in the open position;

a lever including a primary cam, the lever pivotally coupled to the body and arranged to cooperate with the coupling whereby in operation of the fall arrester descent of the user urges the coupling into contact with the lever which pivots to effect movement of the primary cam for braking of the rope passing through the fall arrester between the primary cam and the body; and a tow cam pivotally coupled to the body to provide contact with the lever to pivot it and release the associated primary cam from the rope to permit manual towing of the fall arrester along the rope on its descent.

2. A fall arrester as defined in claim 1 wherein the fall arrester is integrally connected to the coupling.

3. A fall arrester as defined in claim 1 wherein the coupling is in the form of a swivel connector.

4. A fall arrester as defined in claim 1 wherein the cover plate in a closed position maintains retention of the coupling, the base body and the cover plate including slots which define the closed opening.

5. A fall arrester as defined in claim 4 wherein the lever is open-ended and positioned relative to the closed opening with the cover plate in the closed position whereby ascent of the user provides contact of the coupling with the body without contacting the lever, said contact with the body only being effective in to effect raising of the fall arrestor independent of the lever and the primary cam.

6. A fall arrester as defined in claim 1 also comprising an inertial cam pivotally coupled to the lever proximate the primary cam and configured on rapid descent of the user to pivot into contact with the rope to initiate pivotal movement of the lever for braking of the rope with the primary cam.

7. A fall arrester as defined in claim 6 wherein the body is configured with the cover plate in the closed position to substantially house at least the primary cam and the lever.

8. A fall arrester as defined in claim 7 wherein the body includes an inverted cam movably mounted to the base body to only permit closure of the cover plate into the closed position with the fall arrester correctly oriented relative to the rope to ensure braking on descent.

9. A fall arrester comprising:

a body adapted to couple to a user via a coupling;

a lever including a primary cam, the lever pivotally coupled to the body and arranged to cooperate with the coupling whereby in operation descent of the user urges the coupling into contact with the lever which pivots to effect braking of rope passing through the fall arrester between the primary cam and the body, an inertial cam pivotally coupled to the lever proximate the primary cam and configured on rapid descent of the user to pivot into contact with the rope to initiate pivotal movement of the lever for braking of the rope with the primary cam; and a tow cam pivotally coupled to the body to provide contact with the lever to pivot it and release the associated primary cam from the rope to permit manual towing of the fall arrester along the rope on its descent.

10. A fall arrester as defined in claim 9 further comprising a secondary cam connected to the lever whereby gripping the rope and the coupling toward one another urges the rope into contact with the secondary cam pivoting the lever to promote braking of the rope between the primary cam and the body.

11. A fall arrester as defined in claim 10 wherein the secondary cam is pivotally connected to the lever and biased to maintain contact with the rope to hold the fall arrester at a required position along the rope.

12. A fall arrester as defined in claim 10 further comprising a secondary cam lock connected to the lever and arranged to lock the secondary cam in a retracted position to permit sliding movement of the fall arrester in both directions along the rope.

13. A fall arrester as defined in claim 9 further comprising an accelerator element pivotally coupled to the body and adapted to engage the coupling to accelerate contact of the coupling with the lever for accelerated braking of the rope with the primary cam.

14. A fall arrester as defined in claim 13 wherein the accelerator element is operatively coupled to a biasing member which urges the coupling to maintain contact with the lever.

15. A fall arrester as defined in claim 9 wherein the fall arrester is integrally connected to the coupling.

16. A fall arrester as defined in claim 9 wherein the coupling is in the form of a swivel connector.

17. A fall arrester as defined in claim 9 further comprising a secondary cam connected to the lever whereby gripping the rope and the coupling toward one another urges the rope into contact with the secondary cam pivoting the lever to promote braking of the rope between the primary cam and the body.

18. A fall arrester as defined in claim 9 further comprising an accelerator element pivotally coupled to the body and adapted to engage the coupling to accelerate contact of the coupling with the lever for accelerated braking of the rope with the primary cam.

19. A fall arrestor as defined in claim 9 wherein the tow cam is configured relative to the lever to disengage from the lever to permit braking of the rope via the primary cam beyond a predetermined pivot angle of the tow cam.

20. A fall arrestor as defined in claim 19 wherein the tow cam connects to a tow line that is manually pulled to pivot the tow cam to allow towing of the fall arrestor.

21. A fall arrestor defined in claim 20 wherein the tow line includes a mechanical fuse which breaks at a predetermined pull load wherein the tow cam is deactivated.

22. A fall arrester as defined in claim 9 wherein the tow cam is configured relative to the lever to disengage from the lever to permit braking of the rope via the primary cam beyond a predetermined pivot angle of the tow cam.

23. A fall arrester as defined in claim 9 wherein the tow cam connects to a tow line which is manually pulled to pivot the tow cam to allow towing of the fall arrester.

24. A fall arrester as defined in claim 23 wherein the tow line includes a mechanical fuse which breaks at a predetermined pull load wherein the tow cam is deactivated.

* * * * *